US010539135B2

(12) United States Patent
Barbour

(10) Patent No.: US 10,539,135 B2
(45) Date of Patent: Jan. 21, 2020

(54) PROGRESSIVE CAVITY PUMP AND METHOD FOR OPERATING SAME IN BOREHOLES

(71) Applicant: Husky Oil Operations Limited, Calgary (CA)

(72) Inventor: Stephen Gerard Barbour, Lloydminster (CA)

(73) Assignee: Husky Oil Operations Limited, Calgary (CA)

( * ) Notice: Subject to any disclaimer, the term of this patent is extended or adjusted under 35 U.S.C. 154(b) by 0 days.

(21) Appl. No.: 15/706,851

(22) Filed: Sep. 18, 2017

(65) Prior Publication Data

US 2018/0017054 A1 Jan. 18, 2018

Related U.S. Application Data

(62) Division of application No. 14/892,428, filed as application No. PCT/CA2013/050393 on May 23, 2013, now Pat. No. 9,856,872.

(51) Int. Cl.
*F01C 1/10* (2006.01)
*F03C 2/00* (2006.01)
(Continued)

(52) U.S. Cl.
CPC ..... *F04C 13/008* (2013.01); *E21B 43/121* (2013.01); *F04C 2/1071* (2013.01);
(Continued)

(58) Field of Classification Search
CPC .... F04C 2/1071; F04C 2/1073; F04C 2/1075; F04C 13/008; F04C 2230/60;
(Continued)

(56) References Cited

U.S. PATENT DOCUMENTS 3,912,426 A 10/1975 Tschirky
4,580,955 A 4/1986 Karge
(Continued)

FOREIGN PATENT DOCUMENTS

CN 102587827 A 7/2012
CN 102713126 A 10/2012

OTHER PUBLICATIONS

International Search Report and Written Opinion dated Feb. 13, 2014 for International Application No. PCT/CA2013/050393, 6 pgs.
(Continued)

*Primary Examiner* — Theresa Trieu
(74) *Attorney, Agent, or Firm* — Frost Brown Todd LLC; Nicole M. Tepe

(57) ABSTRACT

A method for operating a progressive cavity pump wherein the stator has at least first and second active stator sections that are at different locations on the stator, comprising inserting a first rotor having a first active rotor section that is aligned with the first active stator section, and rotating the first rotor relative to the first active stator section such that the aligned first active rotor and stator sections generate a pumping force. Subsequently, the first rotor is removed and a second rotor is inserted having a second active rotor section that is aligned with the second active stator section, and rotating the second rotor relative to the second active stator section such that the aligned second active rotor and stator sections generate a pumping force.

7 Claims, 9 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 13/00*** | (2006.01) |
| ***F04C 2/107*** | (2006.01) |
| ***E21B 43/12*** | (2006.01) |

(52) U.S. Cl.
CPC .... *F04C 2230/60* (2013.01); *F04C 2230/601* (2013.01); *F04C 2230/604* (2013.01); *F04C 2230/70* (2013.01); *F04C 2230/80* (2013.01)

(58) Field of Classification Search
CPC ..... F04C 2230/601; F04C 2230/604; F04C 2230/70; F04C 2230/80; F01C 1/101; E21B 4/02; E21B 43/121; E21B 43/17
USPC ..... 418/1, 48; 166/377, 378, 381–382
See application file for complete search history.

(56) References Cited

U.S. PATENT DOCUMENTS

| | | | |
|---|---|---|---|
| 4,764,094 | A | 8/1988 | Baldenko et al. |
| 4,957,161 | A | 9/1990 | Cholet et al. |
| 5,209,294 | A | 5/1993 | Weber |
| 6,338,388 | B1 | 1/2002 | Winkler |
| 6,675,902 | B2 | 1/2004 | Rowan et al. |
| 7,201,222 | B2 | 4/2007 | Kanady et al. |

OTHER PUBLICATIONS

Australian Office Action, Patent Examination Report No. 1, dated Mar. 30, 2016 for Application No. AU 2013390586, 2 pgs.
Canadian Office Action dated Sep. 7, 2016 for Application No. CA 2,912,803, 3 pgs.
Chinese Office Action, The First Office Action, and First Search dated Oct. 17, 2016 for Application No. CN 201380078051.X, 8 pgs.

PROGRESSIVE CAVITY PUMP AND METHOD FOR OPERATING SAME IN BOREHOLES

CROSS-REFERENCE TO RELATED APPLICATIONS

This application is a division of U.S. patent application Ser. No. 14/892,428, filed Nov. 19, 2015, entitled "Progressive Cavity Pump and Method for Operating Same in Boreholes," which claims priority to and benefit of International Application No. PCT/CA2013/050393, filed May 23, 2013, entitled "Progressive Cavity Pump and Method for Operating Same in Boreholes," the contents of which are incorporated by reference in their entirety for all purposes.

FIELD

This invention relates generally to a progressive cavity pump and a method for operating same in boreholes such as in oil and gas wellbores.

BACKGROUND

A progressive cavity pump, also commonly known as a Moineau pump, is comprised of two interfacing helical components, namely, a stator and a rotor. Typically the stator comprises a cylindrical metal housing attachable to a tubing string and an elastomeric helical and longitudinally extending cavity mounted to the inside of the metal housing. Typically the rotor comprises a metal helical rod attachable to a rod string. As a general principle, the rotor has a helix having one helical order less than the stator i.e. the rotor has a helical order n and the stator has a helical order of n+1. For example, when the rotor is a single helix of helical order n=1, the stator has a double helix of helical order n=2, and when the rotor is a double helix with n=2, the stator is a triple helix with n=3, and so on. In such configurations open cavities exist within the pump. Rotating the rotor within the stator will cause these cavities to progress and to operate as a pump. Rotational means is typically provided by a motor, which drives the rotor via a rod string. The capacity for a progressive cavity pump to operate against a discharge pressure greater than the intake pressure is proportional to the number of stages within the pump. A stage is equal to one pitch length of the stator, and is defined by one revolution of the stator helix. For a given helix geometry, the pressure capacity of the pump increases as stages are added and the length of the pump increases proportionally. However, as the number of stages in a pump is increased, the required torque to drive the rotor is also increased since the pump becomes longer.

Progressive cavity pumps are particularly useful due to their capable handling of viscous and solid particulate laden fluids and have been deployed in a number of applications including transporting food, slurry, sewage and emulsions. An emulsion may consist of a number of different fluids including, but not limited to, a mixture of oil, water, sand and hydrocarbon gas. When pumping commonly 'harsh' fluids, the pump tends to wear over time to a point where it is no longer effective. Once a progressive cavity pump is no longer effective it must be replaced. In some applications, the cost to replace a progressive cavity pump can be prohibitive due to the cost of the pump parts as well as to the efforts undertaken to access the pump, and particularly the stator.

One application where accessing the stator is particularly challenging and costly is pumping in an oil or water wellbore. In wellbore applications, the pump is generally installed up to several thousand feet below ground level. Current practices for installing such a pump involve attaching the stator to the wellbore's tubing string and providing an inwardly protruding restriction in the tubing string either above or below the stator that is used to locate the rotor relative to the stator (known respectively as a "top locating" or a "bottom locating"); the tubing with the restriction and stator is then inserted into the borehole using a service rig. The rotor is attached to a rod string, which is inserted into the tubing string using the service rig; the rod string and rotor are lowered until contact is made with the restriction, at which point the rotor location relative to the stator is known and a rotor space out procedure may be completed. A variety of other tools can be attached to the rod string or tubing string without interfering with the inwardly protruding restriction or pump components.

Generally, progressive cavity pumps used in wellbores are manufactured and sold in lengths that provide the required pressure capacity, or lift, to bring fluid to surface. If a well operator is satisfied with the pressure capacity and geometry of a particular pump, he would typically only be concerned about the length of the pump if it approached or exceeded the limits required for installation or if torque was a potential problem. In general, the rod string and rotor can be retrieved and reinstalled by a smaller, less expensive unit than a service rig known as a flush-by unit. However, the flush-by unit is generally not capable of retrieving or installing the tubing string and stator and thus the service rig is again required when the pump has worn out and is in need of servicing/repair/replacement. The service rig is deployed to pull out the rod string and rotor, and then pull out the tubing string and stator. The worn stator is then replaced with a new stator and the service rig inserts the tubing string with new stator back into the wellbore. The worn rotor is also replaced and the service rig inserts the rod string with new rotor back into the tubing string. Such work tends to take several hours at significant expense and lost production to the operator.

SUMMARY

According to one aspect of the invention, there is provided a method for operating a progressive cavity pump in a borehole, comprising: mounting a stator to a tubing string and inserting the stator and tubing string into a borehole wherein the stator has at least first and second active stator sections that are at different locations on the stator. The method also comprises a first operating phase involving inserting a first rotor into the tubing string until the first rotor is located at a selected downhole position, wherein the first rotor has a first active rotor section that is aligned with the first active stator section when the first rotor is in the selected downhole position, and rotating the first rotor relative to the stator such that the aligned first active rotor and stator sections generate a pumping force. The method also comprises a second operating phase involving removing the first rotor from the borehole, and inserting a second rotor into the tubing string until the second rotor is located at a selected downhole position, wherein the second rotor has a second active rotor section that is aligned with the second active stator section when the second rotor is in the selected downhole location, and rotating the second rotor relative to the stator such that the aligned second active rotor and stator sections generate a pumping force.

The first and second rotors can be located in the selected downhole location by a top locating step, or by a bottom locating step.

To determine when the method should move from the first operating phase to the second operating phase, the method can further comprise determining the pumping performance of the pump and performing the second operating phase when the determined performance diminishes to a selected threshold.

The first rotor can be mounted to a rod string prior to insertion into the tubing string, and the method can further comprise removing the first rotor and rod string from the borehole using flush-by equipment. After removing the first rotor and rod string from the borehole, one or more sucker rods or continuous rod from the rod string can be replaced when the one or more sucker rods or continuous rod have reached a selected state of wear.

The stator can comprise a third active stator section that is at a different location on the stator from the first and second active stator sections, and the method can further comprise removing the second rotor from the borehole and inserting a third rotor into the tubing string until the third rotor is located at a selected downhole position, then rotating the third rotor relative to the stator such that the aligned third active rotor and stator sections generate a pumping force. The third rotor has a third active rotor section that is aligned with the third active stator section when the third rotor is in the selected downhole location.

The stator can comprise a fourth active stator section that is at a different location on the stator from the first, second and third active stator sections, and the method can further comprise removing the third rotor from the borehole and inserting a fourth rotor into the tubing string until the fourth rotor is located at a selected downhole position, then rotating the fourth rotor relative to the stator such that the aligned fourth active rotor and stator sections generate a pumping force. The fourth rotor has a fourth active rotor section that is aligned with the fourth active stator section when the fourth rotor is in the selected downhole location.

According to another aspect of the invention there is provided a progressive cavity pump assembly for operation in a borehole, comprising: a stator comprising at least first and second active stator sections at different locations on the stator; a first rotor having a first active rotor section that is aligned with the first active stator section when the first rotor is mounted at a selected location relative to the stator; and a second rotor having a second active rotor section that is aligned with the second active stator section when the second rotor is mounted at a selected location relative to the stator.

The pump assembly can further comprise a tubing joint with a tag bar that is mountable to a bottom end of the stator.

The first rotor can comprise a slim rod having a bottom end coupled to the first active rotor section, and a top end connectable to a rod string. The second rotor can comprise a lower section extending below the active rotor section that has a helical surface that engages with a helical cavity of the stator when the second rotor is located in the selected location relative to the stator. The lower section of the second rotor can comprise a paddle extending below the bottom of the stator when the second rotor is located in the selected location relative to the stator.

The first and second rotors can have a rotor head, and the assembly can further comprise a rod box mountable to each rotor head, and a collar mountable directly or indirectly via a pup joint to a top end of the stator. The collar can have an annular shoulder that protrudes inwards into the collar enough to engage the rod box but allow rotation of the first and second rotors extending therethrough. The first rotor can have a length which terminates at the bottom of the first active stator section when the first rotor is located in the selected location relative to the stator. The second rotor can have a length that terminates at or below the bottom of the second active stator section when the second rotor is located in the selected location relative to the stator, and has a portion extending above the second active rotor section that has a helical surface configured to mate with a helical cavity of the stator.

DRAWINGS

FIGS. 1(*a*) and (*b*) are side and sectioned side views of a progressive cavity pump in a first phase of operation according to a first embodiment.

FIGS. 2(*a*) and (*b*) are side and sectioned side views of the progressive cavity pump in a second phase of operation according to the first embodiment.

Figure 5A:
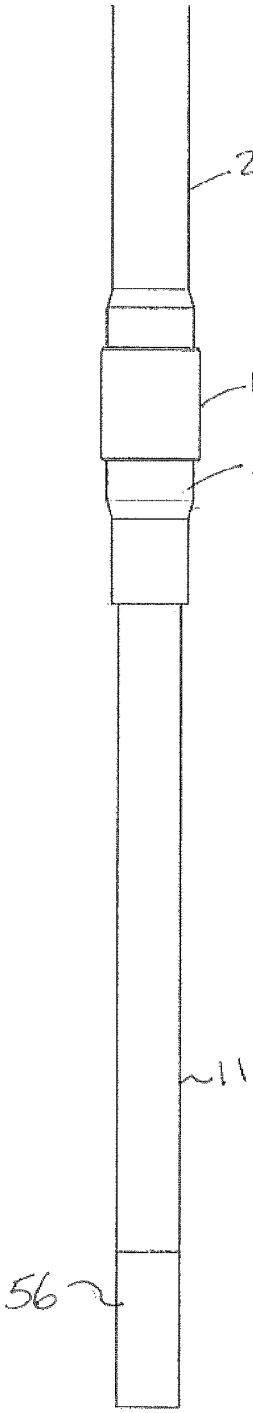
Figure 5B:
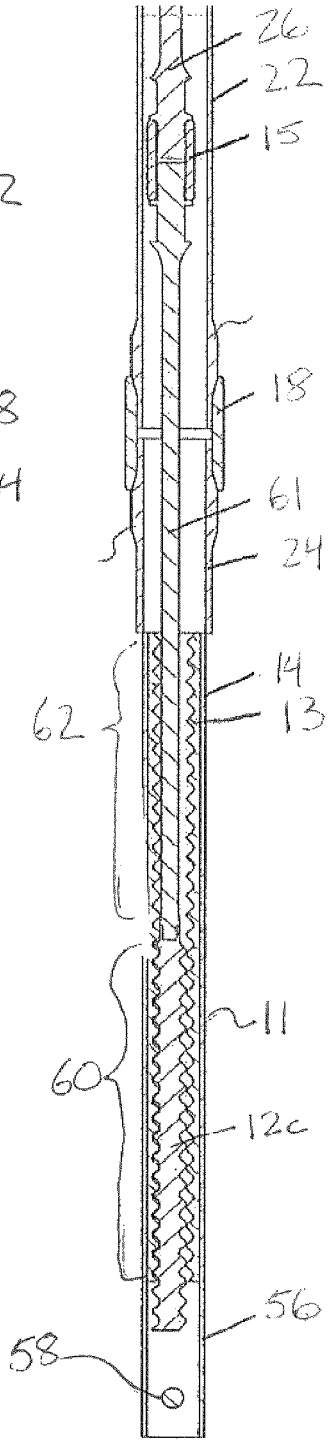

FIGS. 5(*a*) and (*b*) are side and sectioned side views of a progressive cavity pump in a first phase of operation according to a second embodiment.

Figure 6A:
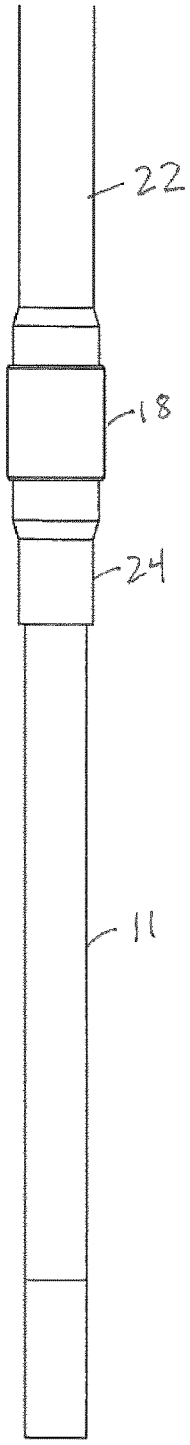

FIGS. 6(*a*) and (*b*) are side and sectioned side views of the progressive cavity pump in a second phase of operation according to the second embodiment.

Figure 7A:
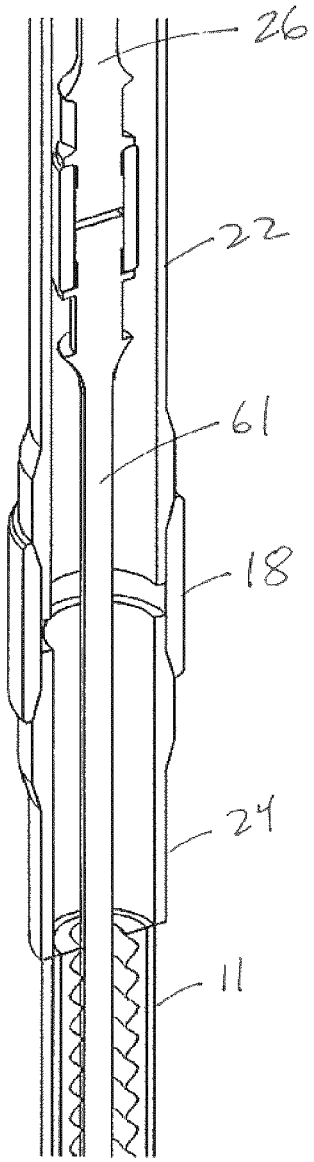
Figure 7B:
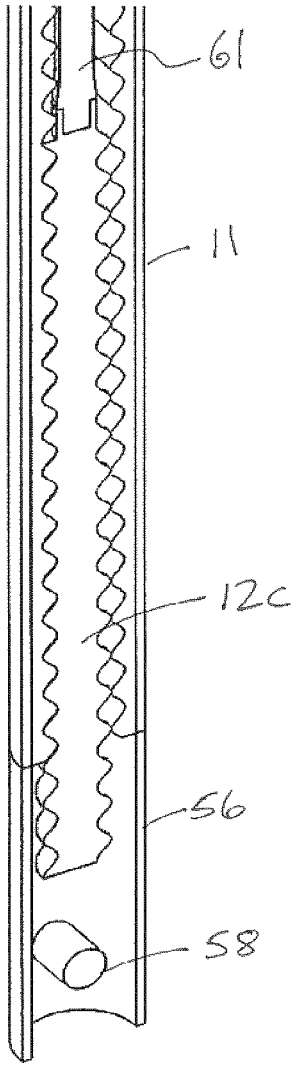

FIGS. 7(*a*) and (*b*) are a perspective sectioned view of a second rotor of the progressive cavity pump used during the second phase of operation according to the second embodiment.

Figure 8:
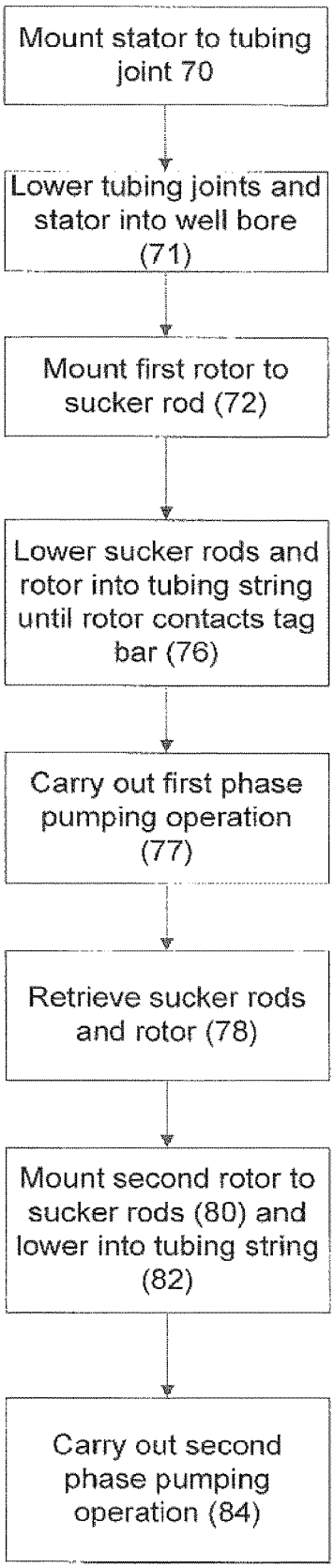

FIG. 8 is a flowchart of the steps carried out during the second embodiment operation.

DETAILED DESCRIPTION

Directional terms such as "upper", "lower", "top", "bottom", "downhole", and "uphole", are used in the following description for the purpose of providing relative reference only, and are not intended to suggest any limitations on how any article is to be positioned during use, or to be mounted in an assembly or relative to an environment. Generally speaking, the terms "upper", "uphole" and "top" refer to portions of a structure that when installed in a vertical wellbore are closer to surface than other portions of the structure, and the terms "lower", "downhole" and "bottom" refers to portions of a structure that when installed in a vertical wellbore are further away from the surface than other portions of the structure.

Embodiments of the invention described herein relate to a progressive cavity pump assembly and a method for operating same in a wellbore. The progressive cavity pump assembly comprises a stator and at least two rotors having active sections at different locations relative to the rotors' heads (first and second active rotor sections), wherein "active rotor section" refers to the portion of the rotor which cooperates with the stator to generate a pumping force. The method comprises at least two operating phases comprising a first phase which uses a first rotor having the first active rotor section, and a second phase which uses a second rotor having the second active rotor section. As the first and second active rotor sections of the first and second rotors are in different locations along the rotors' shaft relative to the rotor head, the active rotor sections engage with different portions of the stator during each operating phase ("first and second active stator sections"). The method can switch from the first operating phase to the second operating phase when the first active rotor section and/or first active stator section wear out, thereby providing the pump with a fresh active rotor section and a fresh active stator section during the second phase operation, by only removing the rod string with the worn first rotor and reinserting the rod string with the fresh second rotor. By avoiding the need to remove and reinstall the tubing string and stator, it is expected that wellbore operating cost and efficiency will be measurably improved.

Two embodiments of the progressive cavity pump assembly operation are illustrated in the accompanying drawings. In particular, a first embodiment operation is shown in FIGS. 1 to 4 that includes a top locating step, and a second embodiment operation is shown in FIGS. 5-8 that includes a bottom locating step.

Apparatus

Figure 1A:
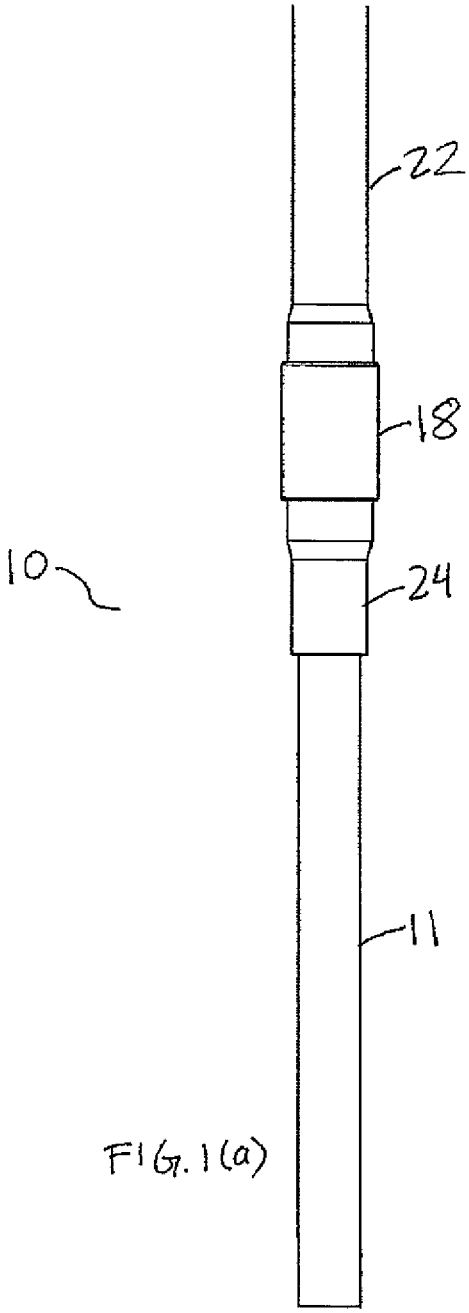
Figure 1B:
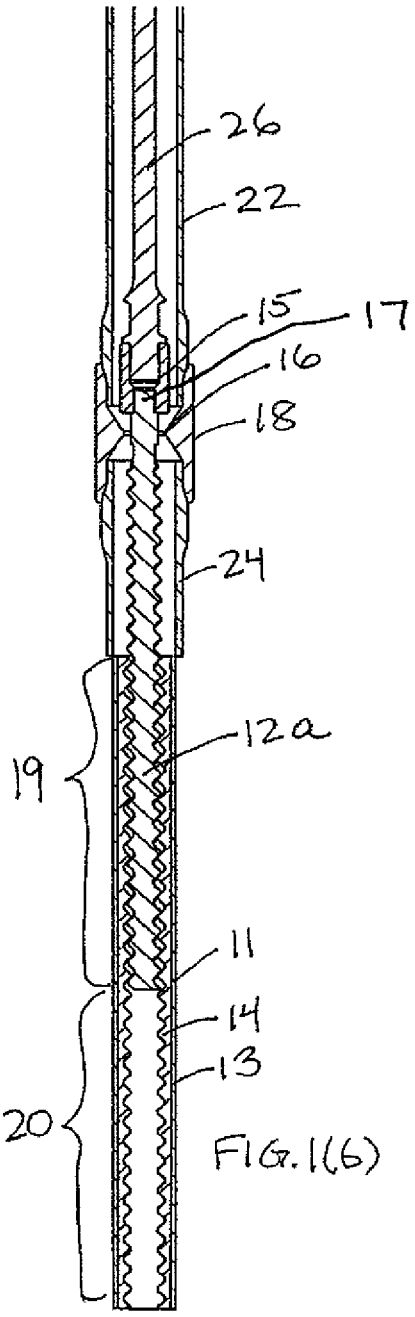
Figure 2A:
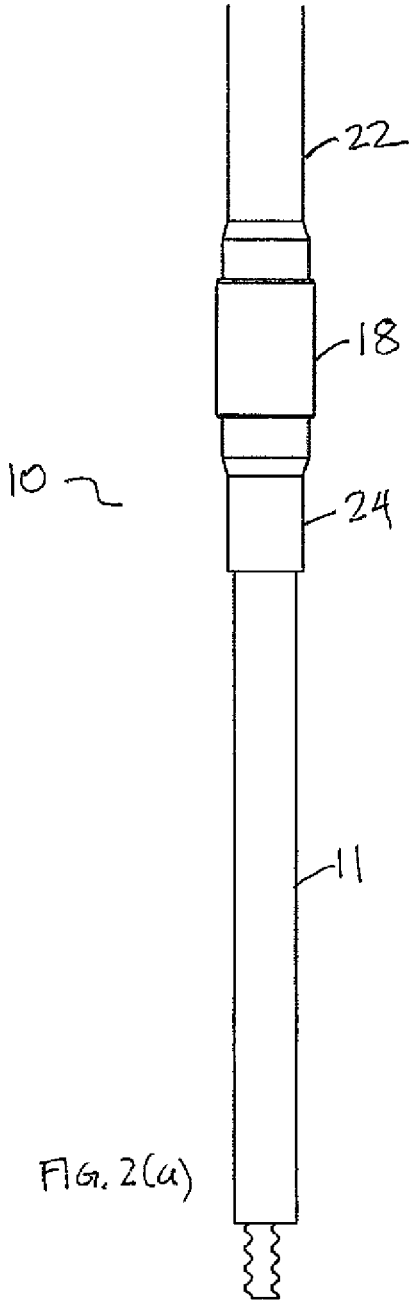

Referring now to FIGS. 1 to 4 and according to the first embodiment, a pumping operation uses a progressive cavity pump 10 assembly comprising a stator 11, a first rotor 12*a* (shown in FIG. 1(*b*)) for use during a first phase of the pumping operation and a second rotor 12*b* (shown in FIG. 2(*b*)) for use during a second phase of the pumping operation. The pumping operation can include additional phases in which case the pump assembly 10 will comprise additional rotors (not shown) as will be described in more detail below.

The stator 11 comprises an outer tubular housing 13 and an inner rotor engagement component 14 attached to the housing 13. The housing 13 serves to provide structural support and encase the rotor engagement component 14 within a tubing string, and can be made of a suitable metal material of the kind used in conventional progressive cavity pumps. The rotor engagement component 14 has an inner surface that defines a helical cavity that extends the length of the stator 11; more particularly, the helical cavity in this embodiment has a double helix configuration designed to operate with a single helix rotor, thereby providing a 1:2 type progressive cavity pump. The rotor engagement component 14 can be composed of an elastomer material of the kind used in conventional downhole progressive cavity pumps.

The first rotor 12*a* in this embodiment is an elongated rod having an upper section and a lower active rotor section below the upper section. The first rotor 12*a* is composed of a metal material of the kind used in conventional progressive cavity pumps. The upper section has a connecting end in the form of a rotor head 17 that is configured to engage with a rod box 15 in a manner that is known in the art; for example, the rotor head 17 can be threaded (not shown) to engage with a matching threaded end of the rod box 15, or be welded to the rod box 15 (not shown). The rod box 15 connects the first rotor 12*a* to the rest of the rod string uphole. The rod box 15 depicted in the FIGS. 1-3 is shown to protrude radially outwards from the surface of the first rotor 12*a* enough to engage an annular restriction or shoulder 16 in a tubing collar 18, thereby locating the first rotor 12*a* in a desired location relative to the stator 11. The engagement of the rod box 15 and annular shoulder 16 is depicted schematically in the Figures, as different commercially available top locating designs can be used by the pump 10 such as the Top Tag™ product sold by KUDU.

The first rotor's active rotor section has a surface forming a single helix that mates with the double helix cavity of the stator 11. The length of the active rotor section is selected to engage with a selected length of the stator's helical cavity which is referred to as the first phase active stator section 19 (the portion of the stator's helical cavity that does not engage with the first rotor 12*a* during the first phase is hereby referred to as the first phase inactive stator section 20). In this embodiment, the length of the first rotor's active rotor section is half of the length of the stator's helical cavity; however, the ratio of the active rotor section length to stator helical cavity length will depend on a number of factors including the number of phases used during the pump operation. For example, when the pumping operation has three phases, the ratio of active rotor section length to stator helical cavity length can be 1:3, and when the pumping operation has four phases, the ratio can be 1:4, and so on. The primary requirement for any active phase is that the length must contain enough useful stator stages, or pitch lengths, so as to overcome the discharge pressure upon operation of the pump.

As can be seen in FIG. 2(*b*), the second rotor 12*b* is also an elongated rod having an upper section and a lower active rotor section below the upper section. The main difference between the first and second rotors 12*a*, 12*b* is that the active rotor section of the second rotor 12*b* is positioned on the second rotor 12*b* such that this active rotor section engages with a portion of the stator's helical cavity during the second phase of the pumping operation, hereby referred to as "second phase active stator section" 30, that is different than the first phase active stator section 19 (the remaining portion of the stator's helical cavity during the second phase is herein referred to as the "second phase worn stator section" 32). In this embodiment, the second phase active stator section 30 is the same as the first phase inactive stator section 20 and the second phase worn stator section 32 is the same as the first phase active stator section 19. The second phase active rotor section has a surface forming a single helix that mates with the stator's double helix cavity. At least part of the rotor above the second phase active rotor section can also feature a single helix surface as is shown in FIG. 2—this enables some additional pumping force to be generated by the pump 10, even though the second phase worn stator section 32 is worn out from use during the first phase. Alternatively but not shown, this part of the second rotor 12*b* above the second phase active rotor section can be a slim rod.

The aforementioned pump 10 apparatus is for use in a two phase pumping operation and will be described below. In other embodiments (not shown), the pump 10 can be provided with additional rotors with additional active rotor sections and a stator with additional active stator sections, for use in a pumping operation having more than two phases.

Installation and Operation

Figure 3:
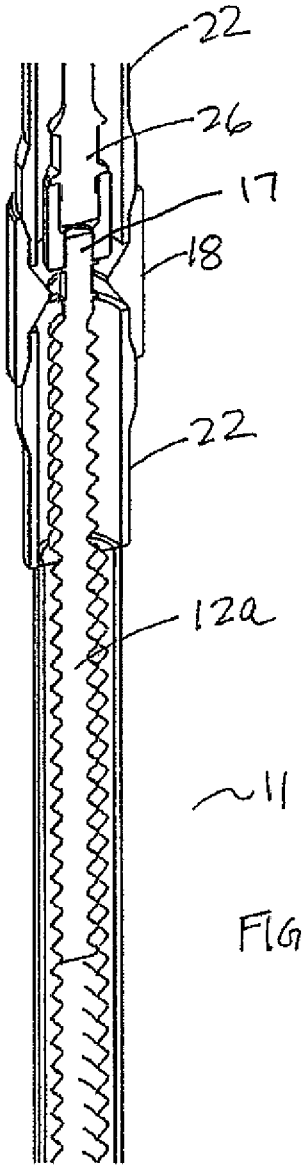
FIG. 3 is a perspective sectioned view of a first rotor of the progressive cavity pump used during the first phase of operation according to the first embodiment.
Figure 4:
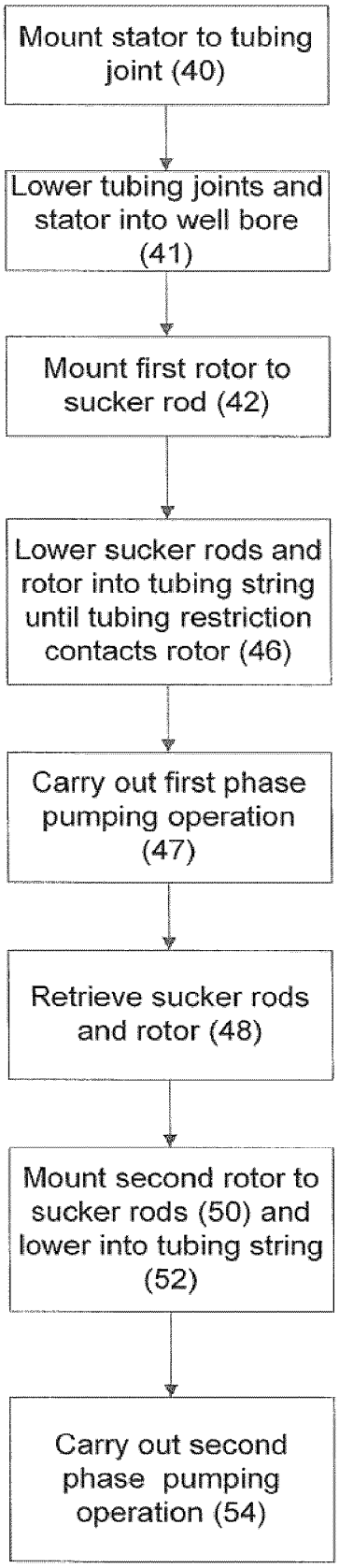
FIG. 4 is a flowchart of the steps carried out during the first embodiment operation.

The operation of the progressive cavity pump 10 will now be described with reference to the flowchart shown in FIG. 4 and the structural components shown in FIGS. 1 to 3. At surface and during an installation step, the stator 11 is mounted to tubing joint 22 of a wellbore tubing string (step 40) and inserted into the wellbore (step 41), and the first rotor 12*a* is mounted to a sucker rod 26 of a rod string (step 42). Alternatively, the stator 11 can be coupled to a continuous tubing string (i.e. coiled tubing, a tubing string that is not composed of separate tubing joints). Also alternatively, the first rotor 12*a* can be mounted on a continuous rod string.

The pump 10 can be part of a new wellhead installation or installed onto an existing wellhead. When the pump 10 is installed onto an existing wellhead, a service rig can be contracted to break down the wellhead, by first pulling up the rod string from the tubing string, then pulling up the tubing string from the wellbore. The old stator and rotor are then replaced with the stator 11 and first rotor 12*a* in the manner described below.

The stator 11 is mounted at its uphole end to the tubing joint 22 by the tubing collar 18 or in another manner as known in the art (e.g. welding). When the diameter of the stator housing 13 does not match the diameter of the tubing joint 22, a pup joint 24 is provided as a transitional piece to couple the stator 11 to the tubing collar 18 in a manner as known in the art. The tubing collar 18 in this embodiment has a generally annular restriction or shoulder 16 that protrudes into the collar's bore; the amount of protrusion of the rod box 15 from the first rotor 12*a* is selected to be sufficient to interfere with the annular shoulder 16 and thus serve as a longitudinal stop which locates the first rotor's active section beside the active stator section 19 during the first phase of the operation.

The first rotor 12*a* is mounted at its rotor head 17 to the sucker rod 26 of the rod string by the rod box 15 in a manner as is known in the art; for example, the rotor head 17 and rod box 15 can be provided with mating threads to allow for a threaded connection.

Once the stator 11 is mounted to the tubing joint 22, the assembly 11, 22 is lowered into the wellbore (not shown) by a service rig (step 41). Additional tubing joints (not shown) are coupled end to end to the assembly 11, 22, to make up a tubing string, until the stator 11 is lowered into a selected position downhole. The tubing string extends from the pump 10 to the surface and serves to fluidly couple the pump 10 to a wellhead (not shown) at surface. The tubing joints 22 also provide pressure isolation between the inside of the tubing string and the annular space between the outside of the tubing 22 and an inner surface of wellbore casing (not shown) into which the tubing string is inserted; this pressure isolation allows fluid to be pumped to surface.

After the stator 11 has reached its selected position, the sucker rod 26 and first rotor 12*a* assembly is lowered into the tubing string by the service rig (step 46). As this assembly 26, 12*a* is lowered, additional sucker rods (not shown) are coupled end to end to the assembly 26, 12*a* until the rod box 15 makes contact with the annular shoulder 16 of the collar 18 (and lifted slightly to account for rod stretch), thereby locating the active rotor section with the first phase active stator section 19, as depicted schematically in the top locating embodiment shown in FIG. 1(*b*). The length of the first rotor 12*a* is selected so that the bottom of the first rotor 12*a* terminates at the bottom of the first phase active stator section 19, thereby leaving the first phase inactive stator section 20 unused.

The rod string at its uphole end is coupled to a polish rod that provides a pressure seal with a stuffing box of a well head rotary drive (not shown) at surface and is driven by the rotary drive, which rotates the rod string and in turn rotates the attached first rotor 12*a*. The mating of the rotor's helical surface with stator's helical cavity create a plurality of individual cavities that progress as the first rotor 12*a* is rotated. Each cavity is separated from each other by a seal line that is created from an interference fit between the first rotor 12*a* and the stator 11, thereby establishing a pressure capacity that creates the pumping force as the first rotor 12*a* is rotated relative the stator 11.

The first rotor 12*a* is rotated in the stator 11 during a first phase pumping operation until the first rotor 12*a* and/or first active stator section 19 has worn out (step 47). Determination of when the first rotor 12*a* and/or stator 11 have worn out enough to be replaced can be based on real-time measurements of pump performance, or based on a predetermined period that is selected based on historical data of rotor and stator wear. For example, the first phase operation can be stopped when the measured rate of fluid pumped to surface by the pump 10 has fallen below a minimum threshold, or when the pump 10 speed needs to be increased to maintain the same rate of fluid extraction. Once the determination has been made that the first rotor 12*a*/first phase active stator section 19 have reached a threshold state of wear, the first phase pumping operation is ended, and the rod string and first rotor 12*a* are retrieved from the wellbore (step 48). The service rig used to install the tubing string and rod string can be used for retrieval; alternatively, flush-by equipment can be used, since such equipment should be capable of extracting the rod string (but not usually the tubing string).

Once the rod string is retrieved, the condition of the sucker rods 26 are inspected and replaced as necessary. The first rotor 12*a* is removed and the second rotor 12*b* is installed onto the rod string (step 50). Then, the second rotor 12*b* is inserted into the tubing string and located by a top locating method (step 52). Once located in place, the active section of the second rotor 12*b* will engage the second phase active stator section 30 (previously the first phase inactive stator section 20 during the first phase operation), and the second phase pump operation is started (step 54). Because the second rotor 12*b* and the second phase active stator section 30 were not used during the first phase pumping operation, it is expected that pump performance will be restored back to initial levels. Pumping performance may actually be enhanced by pumping forces created by the engagement of the helical surface of the second rotor 12*b* with the helical cavity in the second phase worn stator section 32.

Figure 2B:
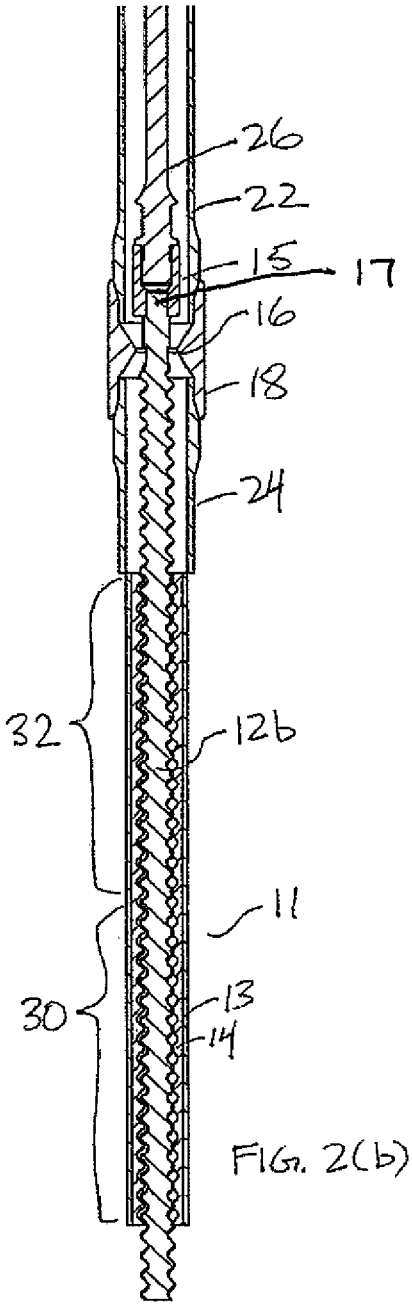

The bottom of the second rotor 12*b* may terminate at the bottom of the stator 11, or protrude out of the bottom of the stator 11 into the well casing and serve to stir up the emulsion in the well casing, as is shown in FIG. 2*b*. The protruding portion of the rotor can be shaped as a paddle (not shown) to enhance emulsion stirring.

As described above, the first embodiment pumping operation utilises a restriction in a tubing string above the stator 11 (annular shoulder 16 in the collar 18, as shown schematically in the FIGS. 1-3) to block an upper portion of the first and second rotors 12*a*, 12*b* from passing therethrough. The rod box 15 and annular shoulder 16 are configured to interact with each other such that the active section of the rotors 12*a*, 12*b* extend through the restriction and is located at a target location along the stator 11. In contrast, the second embodiment operation utilizes a restriction in the tubing string below the stator 11 to block a lower portion of the first and second rotors 12*c*, 12*d* from passing therethrough, as is described below.

Referring now to FIGS. 5 to 8, the second embodiment operation resembles the first embodiment operation except that the collar 18 does not feature an internal restriction, and instead features a tubing joint 56 mounted below the stator 11 with an internal restriction, known as a "tag bar" 58, which serves to block further progression of first and second rotors 12*c*, 12*d* as they are inserted in the tubing string. Using this approach, the first rotor 12*c* can be installed inside the tubing string and an active section of the first rotor 12*c* located alongside a first phase active stator section 60, which in the second embodiment operation is located at the bottom part of the stator 11, and a first phase pumping operation can be carried out. Similarly, the second rotor 12*d* can be installed in the tubing string and an active rotor section of the second rotor 12*d* is located alongside a second phase active stator section 64 that is at a different location on the stator 11 than the first phase active stator section 60 and a second phase pumping operation can be carried out.

The first rotor 12*c* of the second embodiment differs from the first rotor 12*a* of the first embodiment in that the first rotor 12*c* extends all the way to the bottom of the stator 11 (and optionally below the bottom of the stator 11) and the first phase active rotor section is located at the bottom of the first rotor 12*c* such that it can engage with the first phase active stator section 60. The first rotor 12*c* also comprises an upper section comprising a slim rod 61 which connects the first phase active rotor section to the sucker rod 26. This slim rod 61 may be helical in nature to fit the stator geometry, or it may be a slender rod capable of operating without jamming in the stator due to the eccentric, oscillating motion of the first rotor 12*c*. As the slim rod 61 does not engage the portion of the helical cavity of the stator 11 above the first phase active stator section 60, this portion does not contribute to the pumping operation (and is thus referred to as the first phase inactive stator section 62 during the first phase operation).

Figure 6B:
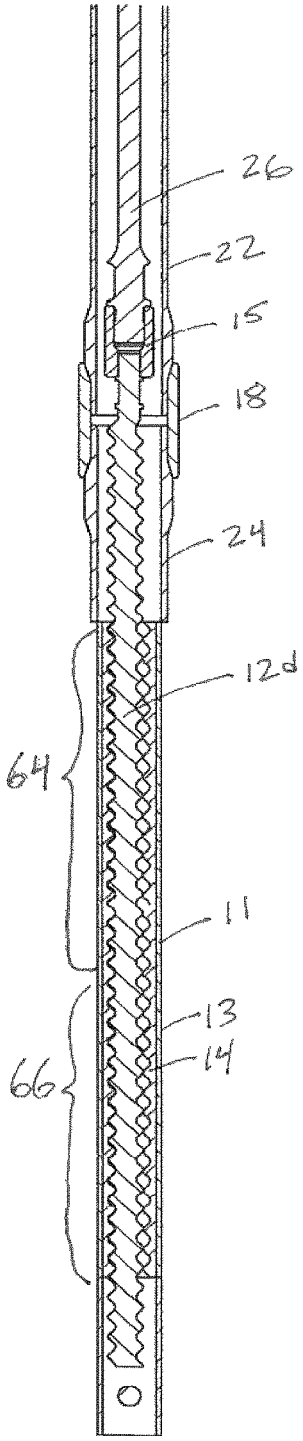

The second rotor 12*d* of the second embodiment can have the same structural design as the second rotor 12*b* of the first embodiment. However, unlike the first embodiment, the active rotor section of the second embodiment of the second rotor 12*d* is located at the top portion of the rotor 12*d*, i.e. the portion that is located alongside the portion of the stator 11 that was the first phase inactive stator section 62 during the first phase operation, and which becomes the second phase active stator section 64 during the second phase operation (FIG. 6*b*). The bottom portion of the second rotor 12*d* is located alongside the portion of the stator 11 that was the first phase active portion 60 during the first phase operation, but will be worn out and thus becomes the second phase worn stator portion 66 during the second phase operation. Since the bottom portion of the second rotor 12*d* features a helical surface, some pumping force can still be produced during the second phase from the second phase inactive stator section 66 provided that portion is not completely worn out. Alternatively, the bottom portion of the rotor 12*d* can be a slim rod with a paddle to (to stir up emulsion) in which case there will be no pumping forces generated from the second phase-worn stator section 66.

Referring to FIG. 8, the pumping operation according to the second embodiment is similar to the first embodiment. At surface, the stator 11 is mounted to tubing joint 22 of the wellbore tubing string (step 70) and then lowered in the wellbore (step 71), and the first rotor 12*c* is mounted to the sucker rod 26 of the rod string (step 72). The tubing joints 22 and stator 11 are lowered into the wellbore (not shown) by the service rig (step 71). After the stator 11 has reached its selected position, the sucker rod 26 and first rotor 12*c* are lowered into the tubing string by the service rig (step 76) until the bottom (distal end) of the rotor 12*c* makes contact with the tag bar 58 thereby locating the active rotor section with the first phase active stator section 60. The first rotor 12*c* is rotated in the stator 11 during the first phase pumping operation (step 77) until the first rotor 12*c* and/or first phase active stator section 60 has worn out. Once the determination has been made that the first rotor 12*c*/first phase active stator section 60 have reached a threshold state of wear, the first phase pumping operation is ended and the rod string and first rotor 12*c* are retrieved from the wellbore (step 78). The first rotor 12*c* is removed and the second rotor 12*d* is installed onto the rod string (step 80). Then, the second rotor 12*d* is inserted back into the tubing string and located in place in the same bottom tag method used to locate the first rotor 12*c* (step 82). This retrieval and installation can be performed by a service rig or a flush-by unit. Once located in place, the active section of the second rotor 12*d* will engage the second phase active stator section 64 (previously the first phase inactive stator section 62 during the first phase operation), and the second phase pump operation is started (step 84).

Like the first embodiment, the second embodiment can feature more than two operating phases. When there are three or more phases, a corresponding number of additional rotors are provided and the stator length is increased accordingly to provide additional active stator sections for the active sections of the additional rotors to engage.

While particular embodiments have been described in the foregoing, it is to be understood that other embodiments are possible and are intended to be included herein. It will be clear to any person skilled in the art that modification of and adjustments to the foregoing embodiments, not shown, are possible. The scope of the claims should not be limited by the preferred embodiments set forth in the examples, but should be given the broadest interpretation consistent with the description as a whole.

The invention claimed is:

1. A progressive cavity pump assembly for operation in a borehole, comprising:

(a) a unitary stator comprising at least first and second active stator sections at different locations on the stator;

(b) a first rotor having a first active rotor section that is configured for alignment with the first active stator section when the first rotor is positioned at a selected location relative to the stator; and (c) a second rotor separate from the first rotor and configured for insertion into the stator independently of the first rotor such that only one of the first rotor and the second rotor is capable of insertion within the stator at a given time, the stator configured to receive only one of the first rotor and the second rotor at a given time, and the second rotor having a second active rotor section that is configured for alignment with the second active stator section when the first rotor is absent from the stator and the second rotor is positioned at the selected location relative to the stator, the first rotor and the second rotor configured for separate and serial operation within the stator.

2. The pump assembly as claimed in claim 1 further comprising a tubing joint mountable to a bottom end of the stator, the tubing joint having a tag bar.

3. The pump assembly as claimed in claim 2 wherein the first rotor comprises a slim rod having a bottom end coupled to the first active rotor section, and a top end connectable to a rod string.

4. The pump assembly as claimed in claim 3 wherein the second rotor comprises a lower section extending below the second active rotor section that has a helical surface that engages with a helical cavity of the stator when the second rotor is located in the selected location relative to the stator.

5. The pump assembly as claimed in claim 1 wherein the first and second rotors each have a rotor head, and the assembly further comprises a rod box mountable to each rotor head, and a collar mountable directly or indirectly via a pup joint to a top end of the stator, the collar having an annular shoulder that protrudes inwards into the collar enough to engage the rod box longitudinally but allow rotation of the first and second rotors extending therethrough.

6. The pump assembly as claimed in claim 5 wherein the first rotor has a length which terminates at the bottom of the first active stator section when the first rotor is located in the selected location relative to the stator.

7. The pump assembly as claimed in claim 5 wherein the second rotor has a length that terminates at or below the bottom of the second active stator section when the second rotor is located in the selected location relative to the stator, and has a portion extending above the second active rotor section that has a helical surface configured to mate with a helical cavity of the stator.

* * * * *